United States Patent [19]

Heyer et al.

[11] 4,077,801

[45] Mar. 7, 1978

[54] IRON-CHROMIUM-NICKEL HEAT RESISTANT CASTINGS

[75] Inventors: Bruce A. Heyer, Mahwah; Donald L. Huth, Ringwood, both of N.J.

[73] Assignee: Abex Corporation, New York, N.Y.

[21] Appl. No.: 824,637

[22] Filed: Aug. 15, 1977

Related U.S. Application Data

[63] Continuation-in-part of Ser. No. 793,848, May 4, 1977, abandoned.

[51] Int. Cl.[2] ..... C22C 30/00; C22C 38/44; C22C 38/48; C22C 38/50

[52] U.S. Cl. ..... 75/122; 75/128 A; 75/128 C; 75/128 N; 75/128 G; 75/128 T; 75/128 W; 75/134 N; 75/171

[58] Field of Search ..... 75/122, 134, 171, 128 W, 75/128 T, 128 V, 128 A, 128 C, 128 N, 128 G

[56] References Cited

U.S. PATENT DOCUMENTS 3,826,649 7/1974 Söderberg et al. ..... 75/124

FOREIGN PATENT DOCUMENTS 1,252,218 11/1971 United Kingdom ..... 75/128 B

OTHER PUBLICATIONS

Iron Age, "Low-Swelling Stainless Key to LMFBR development," Jan. 1976, pp. 34–35.

*Primary Examiner*—Arthur J. Steiner
*Attorney, Agent, or Firm*—Kinzer, Plyer, Dorn & McEachran

[57] ABSTRACT

Castings of carbon 0.25/0.8, nickel 8/62, chromium 12/32, tungsten 0.05/2, titanium 0.05/1, balance iron (substantially) of austenitic microstructure, essentially free of cobalt and molybdenum, and not requiring heat treatment to develop service properties considerably improved compared to standard ACI alloy grades.

6 Claims, 6 Drawing Figures

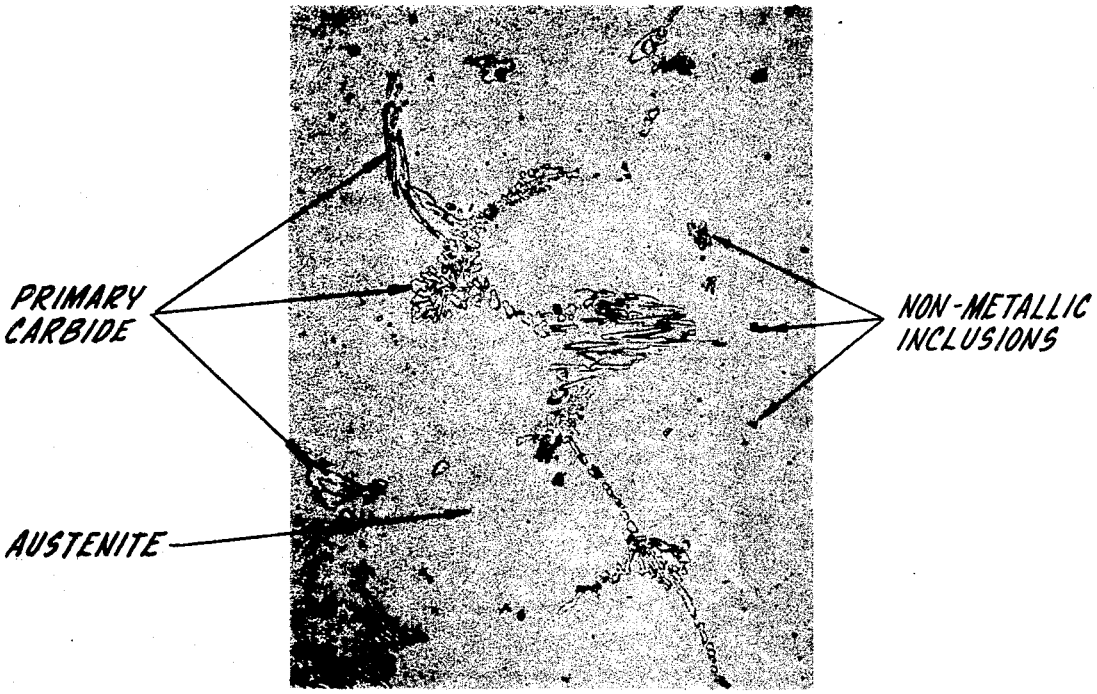
fig.5.
fig.6.
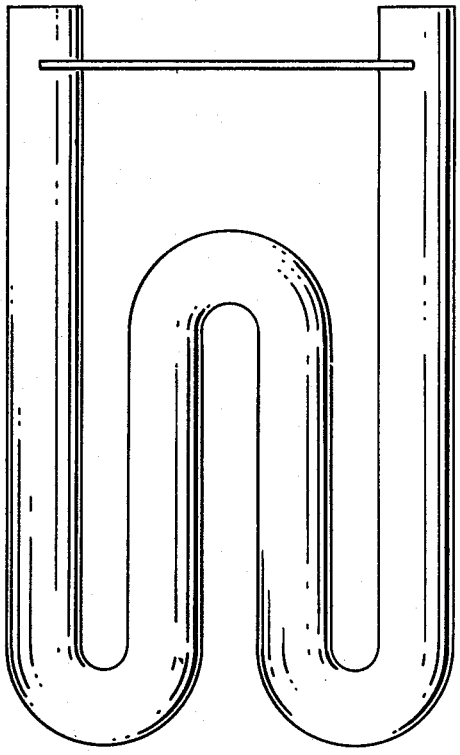

IRON-CHROMIUM-NICKEL HEAT RESISTANT CASTINGS

RELATED APPLICATION

This application is a continuation-in-part of application Ser. No. 793,848, filed May 4, 1977, now abandoned.

This invention relates to a class of alloys which feature in castings employed in hydrogen reformer service as well as related types of castings widely used for high temperature industrial applications.

These alloys are standardized by the Alloy Casting Institute (ACI) Division of the Steel Founders' Society of America. The generally available specifications are ASTM A297, A447, A567 and A608.

The ACI designation uses the prefixes of H and C to indicate suitability for heat-resistant and corrosion service, respectively. The second letter is arbitrarily assigned to show alloy type, with a rough alphabetical sequence as nickel content rises (see Table A). There is provision for showing carbon content of the H grades, the numbers following the two letters being the midpoint of the carbon specification.

The function of the various alloying elements differ; for instance, chromium increases oxidation resistance and corrosion by hot gases. Manganese and silicon are added for steel-making purposes, but silicon also influences oxidation and carburizing resistance. Nickel confers the austenitic structure associated with hot strength, but it also confers resistance to carburization and to some extent oxidation resistance. High nickel alloys, however, are vulnerable to sulphur attack, especially under reducing conditions. Carbon is a potent element for controlling hot strength; nitrogen may also be important for strength.

The ACI standard grades which feature predominatly in the invention are those set forth in Table A below:

TABLE A

| Cast Alloy Designation | C | | Mn max. | Si max. | P max. | S max. | Cr | Ni | Other Elements |
|---|---|---|---|---|---|---|---|---|---|
| | Cast Heat Resistant Alloys for Industrial Applications Composition-percent (balance Fe) | | | | | | | | |
| HF | 0.20 | 0.40 | 2.00 | 2.00 | 0.04 | 0.04 | 19–23 | 9–12 | Mo 0.5 max.* |
| HH | 0.20 | 0.50 | 2.00 | 2.00 | 0.04 | 0.04 | 24–28 | 11–14 | Mo 0.5 max.*N 0.2 max. |
| HI | 0.20 | 0.50 | 2.00 | 2.00 | 0.04 | 0.04 | 26–30 | 14–18 | Mo 0.5 max.* |
| HK | 0.20 | 0.60 | 2.00 | 2.00 | 0.04 | 0.04 | 24–28 | 18–22 | Mo 0.5 max.* |
| HL | 0.20 | 0.60 | 2.00 | 2.00 | 0.04 | 0.04 | 28–32 | 18–22 | Mo 0.5 max.* |
| HN | 0.20 | 0.50 | 2.00 | 2.00 | 0.04 | 0.04 | 19–23 | 23–27 | Mo 0.5 max.* |
| HP | 0.35 | 0.75 | 2.00 | 2.00 | 0.04 | 0.04 | 24–28 | 33–37 | Mo 0.5 max.* |
| HT | 0.35 | 0.75 | 2.00 | 2.50 | 0.04 | 0.04 | 15–19 | 33–37 | Mo 0.5 max.* |
| HU | 0.35 | 0.75 | 2.00 | 2.50 | 0.04 | 0.04 | 17–21 | 37–41 | Mo 0.5 max.* |
| HW | 0.35 | 0.75 | 2.00 | 2.50 | 0.04 | 0.04 | 10–14 | 58–62 | Mo 0.5 max.* |

*Excess amounts cause oxidation

While high temperature strength, measured as creep rupture strength, is usually the predominant property of interest in this alloy class, ductility may be of equal importance in a casting subjected to repeated tensile stresses in a service environment where large temperature differentials result in repeated expansion and contraction of the casting, which is inherent in certain discontinuous high temperature processes as distinguished from a continuous process conducted at a substantially constant temperature. Even so, good ductility (the ability to stretch predictably without suddenly and unexpectedly fracturing under certain loads) is invariably deemed a valuable characteristic to the design engineer because it represents a reserve against failure, which is to say that if two steels are of equal strength, at the same cost, the one having superior ductility will be chosen because of its capacity to signal approaching failure prior to catastrophic failure.

Welding these castings as an incident to cosmetic repair and/or assembly into larger units, after being cast, is desirable and necessary for the most part. Hot ductility contributes in a very large way to being able to weld without cracking: hot ductility allows the metal to stretch suddenly while the weld is being made, and to contract afterwards, without cracking.

The objects of the present invention are to enhance hot tensile strength and to substantially improve hot ductility and creep rupture strength over virtually the entire range of austenitic standard ACI alloys, and to accomplish this by means of very small additions to the standard alloy bases not heretofore recognized as promoting so great an effect over so wide a range of alloy composition, which additions are inexpensive, do not involve strategic (domestically scarce) elements and which indeed enable the invention to be applied to the standard ACI grades with scarcely any increase in cost.

IN THE DRAWING

FIG. 5 is a photomicrograph (500×) exhibiting typical microstructure (HP grade alloy) characterizing alloys of the present invention;

FIG. 6 is a perspective view of heat resistant alloy castings assembled into a unit ready for installation.

TABLE I

Figure 1:
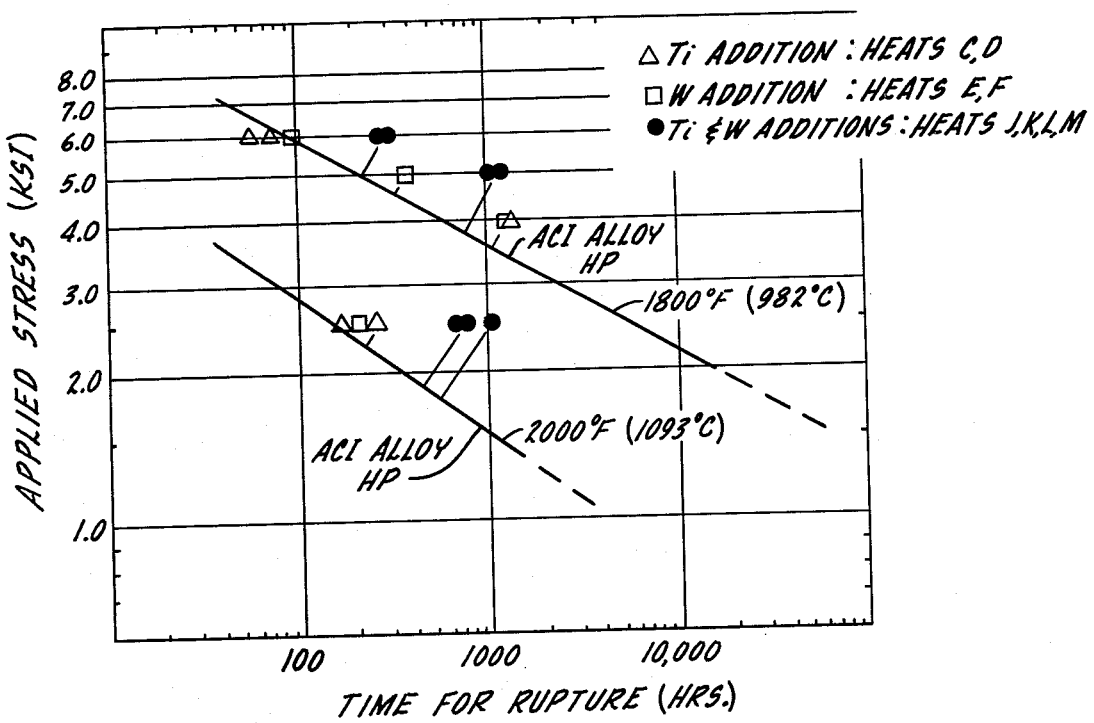
FIGS. 1, 2, 3 and 4 are plots, on logarithmic scale, of data presented in Tables I, II, III and IV, respectively; the bold reference lines are for the standard alloy in each instance and the lighter lines perpendicular thereto denote the advantageous displacements achieved under the present invention.

| Heat No. | | C % | Mn % | Si % | Cr % | Ni % | W % | Ti % | N % | Heat No. |
|---|---|---|---|---|---|---|---|---|---|---|
| | | Effect of Alloying (23% Cr, 35% Ni) Heat Resistant Alloy with Titanium and Tungsten Chemical Composition - Weight Percent | | | | | | | | |
| (A) | 46–681 | .49 | .87 | 1.36 | 26.60 | 34.90 | — | — | .060 | (A) |
| (B) | 76–407 | .48 | .62 | .94 | 23.25 | 35.21 | — | —, .100 | (B) | |
| (C) | 76–139 | .51 | .62 | 1.01 | 22.80 | 34.90 | — | .12 | 1.20 | (C) |
| (D) | 76–144 | .46 | .59 | 1.03 | 22.80 | 34.56 | — | .30 | .102 | (D) |

TABLE I-continued

Effect of Alloying (23% Cr, 35% Ni)
Heat Resistant Alloy with Titanium and Tungsten

| | | | | | | | | | | |
|---|---|---|---|---|---|---|---|---|---|---|
| (E) | AS1394 | .51 | .89 | 1.71 | 23.50 | 33.64 | 5.35 | — | .103 | (E) |
| (F) | AX69 | .48 | .38 | 1.16 | 21.40 | 37.00 | 5.07 | — | — | (F) |
| (G) | 76-148 | .52 | .61 | 1.00 | 22.60 | 35.15 | .51 | .16 | .107 | (G) |
| (H) | 76-103 | .38 | .59 | 1.10 | 22.34 | 35.91 | 1.04 | .16 | .109 | (H) |
| (I) | 76-121 | .46 | .56 | 1.03 | 22.00 | 35.90 | 1.04 | .22 | .110 | (I) |
| (J) | 76-162 | .43 | .63 | .38 | 22.90 | 35.50 | .52 | .32 | .072 | (J) |
| (K) | 76-440 | .43 | .64 | .62 | 23.16 | 36.60 | .56 | .43 | .101 | (K) |
| (L) | 76-370 | .48 | .56 | .49 | 23.23 | 35.48 | .56 | .48 | .124 | (L) |
| (M) | 76-342 | .45 | .63 | .91 | 23.30 | 34.72 | .54 | .49 | .073 | (M) |
| (N) | 76-375 | .47 | .56 | .52 | 22.40 | 35.22 | 1.06 | .76 | .098 | (N) |
| (O) | 76-379 | .47 | .57 | .50 | 22.35 | 34.93 | .58 | 1.16 | .092 | (O) |

Rupture Life at Conditions Specified
Hours

| | 1800° F-6.0 Ksi | 1800° F-5.0 Ksi | 1800° F-4.0 Ksi | 2000° F-2.5 Ksi | |
|---|---|---|---|---|---|
| (A) | 23 | — | — | 196 | (A) |
| (B) | 35 | 149 | | 214 | (B) |
| (C) | 57 | — | 1252 | 182 | (C) |
| (D) | 73 | — | 1342 | 264 | (D) |
| (E) | 94 | — | — | 214 | (E) |
| (F) | — | 380 | 1232 | 193 | (F) |
| (G) | 80 | — | 1649 | 295 | (G) |
| (H) | 78 | — | 2005 | 296 | (H) |
| (I) | 122 | — | 2249 | 435 | (I) |
| (J) | 306 | 1015 | — | 813 | (J) |
| (K) | 279 | — | — | 1056 | (K) |
| (L) | — | — | — | 701 | (L) |
| (M) | — | 1206 | — | — | (M) |
| (N) | 91 | — | — | 622 | (N) |
| (O) | 79 | — | — | 453 | (O) |

Conversion Units (and see Tables following):

| ° F | ° C | Ksi | MPa | kg/mm$^2$ |
|---|---|---|---|---|
| 1400 | 760 | 1.5 | 10.34 | 1.0546 |
| 1600 | 871 | 2.0 | 13.79 | 1.4061 |
| 1800 | 982 | 2.5 | 17.24 | 1.7577 |
| 2000 | 1093 | 4.0 | 27.58 | 2.8123 |
| | | 5.0 | 34.47 | 3.5153 |
| | | 6.0 | 41.37 | 4.2184 |

[1]Heat A is representative of HP, the nearest standard ACI alloy to heat (B).
[2]Heats C and D show the effect of increasing amounts of titanium in the absence of tungsten.
[3]Heats G and H show that increasing quantities of tungsten from .51 to 1.04 at a constant .16% titanium level offer no appreciable advantage to creep rupture strength.
[4]Heats E and F containing 5%W, 0% titanium show an advantage over the standard alloy base, but each is inferior in creep rupture strength to heats alloyed with tungsten plus a minimum .16% titanium.
[5]Heats J, K, L and M fall in the alloy range for optimum creep rupture strength.
[6]Hot tensile data were not collected for heat (B) and accordingly hot tensile data are not comparable.

TABLE II

Effect of Alloying (25% Cr, 20% Ni)
Heat Resistant Alloy with Titanium and Tungsten

| | Heat No. | C % | Mn % | S % | P % | S % | Cr % | Ni % | W % | Ti % | N % | |
|---|---|---|---|---|---|---|---|---|---|---|---|---|
| (A) | Published Data Typical Analysis | .45 | .50 | 1.0 | .02 | .02 | 25.0 | 20.0 | — | — | — | (A) |
| (B) | N461 | .41 | .44 | 1.12 | — | — | 24.8 | 21.0 | .10 | .02 | .126 | (B) |
| (C) | 74-096 | .39 | .60 | .99 | .012 | .014 | 24.1 | 19.3 | — | .16 | .150 | (C) |
| (D) | 73-411 | .39 | .51 | .94 | .011 | .010 | 25.5 | 19.6 | — | .24 | .140 | (D) |
| (E) | 73-406 | .39 | .53 | .96 | .013 | .006 | 24.3 | 19.5 | — | .18 | .160 | (E) |
| (F) | 73-258 | .41 | .60 | 1.10 | .014 | .014 | 24.5 | 20.1 | .10 | .25 | .160 | (F) |
| (G) | 74-250 | .45 | .55 | 1.09 | .012 | .014 | 25.7 | 20.1 | .11 | .18 | .140 | (G) |

Rupture Life at Conditions Specified
Hours

| | 1800° F-6.0 Ksi | 1800° F-4.0 Ksi | 2000° F-2.0 Ksi | |
|---|---|---|---|---|
| (A) | 35 | 220 | 150 | (A) |
| (B) | 40 | 263 | — | (B) |
| (C) | — | 360 | — | (C) |
| (D) | 51 | 536 | — | (D) |
| (E) | — | 634 | — | (E) |
| (F) | 140 | 1371 | 557 | (F) |
| (G) | 197 | 1094 | 937 | (G) |

Hot Tensile Property Comparison
(25% Cr, 20% Ni)

| Heat | Temp. (° F) | Tensile Strength (Ksi) | Yield Stength -.2%- (Ksi) | Elongation (%) | Reduction of Area (%) |
|---|---|---|---|---|---|
| ACI (A) | 1400 | 37.5 | 24.4 | 12.0 | — |
| (F) | 1400 | 45.3 | 28.7 | 28.0 | 31.9 |
| (F) | 1400 | 46.3 | 29.1 | 36.0 | 32.4 |
| ACI (A) | 1600 | 23.3 | 14.7 | 16.0 | — |
| (F) | 1600 | 25.9 | 20.6 | 44.0 | 57.8 |

TABLE II-continued

| | | | | | |
|---|---|---|---|---|---|
| Effect of Alloying (25% Cr, 20% Ni) Heat Resistant Alloy with Titanium and Tungsten | | | | | |
| (F) | 1600 | 26.6 | 20.6 | 46.5 | 60.8 |
| ACI (A) | 1800 | 12.4 | 8.7 | 42.0 | — |
| (F) | 1800 | 15.7 | 12.6 | 51.0 | 71.0 |
| (F) | 1800 | 16.4 | 13.1 | 50.0 | 72.0 |
| ACI (A) | 2000 | 5.6 | 5.0 | 55.0 | — |
| (F) | 2000 | 8.4 | 7.5 | 75.5 | 77.7 |
| (F) | 2000 | 8.5 | 7.7 | 60.0 | 77.8 |

[1]Heat A is a typical HK alloy, the properties of which represent the central tendency of published data.
[2]Heat B shows no beneficial effect on creep rupture strength with a .10% tungsten and .02% titanium addition.
[3]Heats C, D and E show some improvement in creep rupture strength with small titanium additions in the absence of tungsten.
[4]Heats F and G show the effect of alloying with the same tungsten level as in Heat B, with a modest increase in titanium content.
[5]Note considerable enhancement of hot tensile strength and ductility comparing heats A and F.

TABLE III

Effect of Alloying (25% Cr, 12% Ni) Heat Resistant Alloy with Titanium and Tungsten Chemical Composition-Weight Percent

| | Heat No. | C % | Mn % | Si % | Cr % | Ni % | W % | Ti % | N % | |
|---|---|---|---|---|---|---|---|---|---|---|
| (A) | Published Data Typical Analysis | .35 | .50 | 1.0 | 25.0 | 12.0 | — | | .08 | (A) |
| (B) | 76-492 | .36 | .57 | .93 | 24.6 | 13.2 | .36 | .43 | .13 | (B) |

Rupture Life at Conditions Specified Hours

| | 1600° F-6.0 Ksi | 1600° F-5.0 Ksi | 1800° F-6.0 Ksi | 1800° F-5.0 Ksi | |
|---|---|---|---|---|---|
| (A) | 165 | 340 | 12 | 21 | (A) |
| (B) | 883 | 1971 | 83 | 298 | (B) |

Hot Tensile Property Comparison (25% Cr, 12% Ni)

| Heat | Temp. (° F) | Tensile Strength (Ksi) | Yield Strength -.2%- (Ksi) | Elongation (%) | Reduction of Area (%) |
|---|---|---|---|---|---|
| ACI (A) | 1400 | 37.4 | 19.8 | 16.0 | — |
| (B) | 1400 | 40.1 | 22.6 | 42.5 | 43.1 |
| (B) | 1400 | 40.5 | 22.8 | 40.0 | 43.4 |
| ACI (A) | 1600 | 21.5 | 16.0 | 18.0 | — |
| (B) | 1600 | 24.0 | 17.9 | 53.5 | 52.1 |
| (B) | 1600 | 23.7 | 17.7 | 68.5 | 55.2 |
| ACI (A) | 1800 | 10.9 | 7.3 | 31.0 | — |
| (B) | 1800 | 12.3 | 9.8 | 73.0 | 64.7 |
| (B) | 1800 | 13.8 | 10.8 | 73.0 | 53.4 |
| ACI (A) | 2000 | 5.5 | — | — | — |
| (B) | 2000 | 7.6 | 6.8 | 73.5 | 62.9 |
| (B) | 2000 | 7.7 | 6.9 | 69.0 | 60.3 |

[1]Heat A is a typical HH alloy, the properties of which represent the central tendency of published data.
[2]Heat B shows the effect of alloying with small tungsten and titanium additions.
[3]Note considerable enhancement of hot tensile strength and ductility.

TABLE IV

Effect of Alloying (22% Cr, 25% Ni) Heat Resistant Alloy with Titanium and Tungsten Chemical Composition-Weight Percent

| | Heat No. | C % | Mn % | Si % | Cr % | Ni % | W % | Ti % | N % | |
|---|---|---|---|---|---|---|---|---|---|---|
| (A) | Published Data Typical Analysis | .40 | .50 | 1.0 | 21.0 | 25.0 | — | — | — | (A) |
| (B) | 76-500 | .40 | .64 | 1.35 | 22.0 | 24.6 | .41 | .39 | .132 | (B) |

Rupture Life At Conditions Specified Hours

| | 1800° F-6.0 Ksi | 1800° F-4.0 Ksi | 2000° F-2.5 Ksi | 2000° F-1.5 Ksi | |
|---|---|---|---|---|---|
| (A) | 70 | 470 | 150 | 630 | (A) |
| (B) | 268 | 2070 | 411 | 1884 | (B) |

Hot Tensile Property Comparison (22% Cr, 25% Ni)

| Heat | Temp. (° F) | Tensile Strength (Ksi) | Yield Stength -.2%- (Ksi) | Elongation (%) | Reduction of Area (%) |
|---|---|---|---|---|---|
| ACI (A) | 1600 | 20.2 | 14.5 | 37.0 | — |
| (B) | 1600 | 23.5 | 18.4 | 51.0 | 59.7 |
| (B) | 1600 | 24.1 | 17.8 | 54.0 | 69.4 |
| ACI (A) | 1800 | 11.9 | 9.6 | 51.0 | — |

TABLE IV-continued

| Effect of Alloying (22% Cr, 25% Ni) Heat Resistant Alloy with Titanium and Tungsten | | | | | |
|---|---|---|---|---|---|
| (B) | 1800 | 13.5 | 10.1 | 66.0 | 73.4 |
| (B) | 1800 | 14.6 | 11.2 | 67.5 | 63.4 |
| ACI (A) | 2000 | 6.16 | 4.92 | 55.0 | — |
| (B) | 2000 | 7.67 | 6.97 | 57.5 | 70.6 |
| (B) | 2000 | 7.63 | 7.05 | 51.0 | 75.4 |

[1]Heat A is a typical HN alloy, the properties of which represent the central tendency of published data.
[2]Heat B shows the effect of alloying with small tungsten and titanium additions.
[3]Shows same trend for hot tensile strength and ductility.

TABLE V

Effect of Alloying (23% Cr, 35% Ni)
Heat Resistant Alloy With Titanium, Tungsten, and Niobium

| Heat No. | | Chemical Composition C % | Mn % | Si % | Cr % | Ni % | W % | Ti % | Nb % | N % | Heat No. | |
|---|---|---|---|---|---|---|---|---|---|---|---|---|
| (A) | 407 | .48 | .62 | .94 | 23.25 | 35.21 | — | — | — | .101 | (A) | 407 |
| (B) | 681 | .49 | .87 | 1.36 | 26.60 | 34.90 | — | — | — | .060 | (B) | 681 |
| (C) | 408 | .51 | .63 | 1.05 | 23.07 | 35.36 | — | — | .35 | .160 | (C) | 408 |
| (D) | 411 | .51 | .56 | .92 | 22.68 | 35.56 | .54 | — | .36 | .117 | (D) | 411 |
| (E) | 162 | .43 | .63 | .38 | 22.90 | 35.50 | .52 | .32 | — | .072 | (E) | 162 |
| (F) | 373 | .43 | .57 | .74 | 22.52 | 35.15 | .56 | .42 | .38 | .153 | (F) | 373 |

| Rupture Life At Conditions Specified | 1800° F 6.0 Ksi-Hrs. | 1800° F 5.0 Ksi-Hrs. | 2000° F 2.5 Ksi-Hrs. | |
|---|---|---|---|---|
| (A) | 35 | 149 | — | (A) |
| (B) | 23 | — | 196 | (B) |
| (C) | 81 | 371 | — | (C) |
| (D) | 149 | 708 | 278 | (D) |
| (E) | 306 | 1015 | 813 | (E) |
| (F) | 174 | 936 | 131 | (F) |

Niobium contributes to creep rupture strength as can be seen by comparing heat C to heats A and B of Table V. There is an improvement with tungsten (heat D) but not nearly so pronounced as the strengthening possible with tungsten and titanium evident when comparing heats D and E. That Nb is deficient in this regard is evident when comparing heat F, TABLE V to heat K, TABLE I. Niobium, possibly up to 2%, may be included in an alloy which contains both tungsten and titanium, and doubtless other small additions as well, but at the risk of reducing the high temperature creep rupture strength, particularly at 2000° F.

Experience with these castings establishes that with titanium levels greater than 1% it is difficult to produce castings which do not contain massive, titanium-rich non-metallic inclusions, in the form of $TiO_2$ or even more complex oxides of titanium, which detract from tensile properties. This is established by the data in TABLE VI (below) comparing heats K and O of TABLE I; these data, to the metallurgist, mean more than about 1% titanium is to be avoided throughout the range of the standard ACI grades. In view of these values and bearing in mind that titanium has a great affinity for oxygen, requiring a careful deoxidation practice before adding titanium, we therefore set a limit of less than 1% titanium and preferably no more than about 0.96%.

TABLE VI

Effect Of Inclusions Due to High (1.0%) Titanium Content On (Room Temperature) Tensile Properties

| Heat No. | Ti % | Tensile Strength (Ksi) | Yield Strength (Ksi) | Elong (%) | Red. Area (%) |
|---|---|---|---|---|---|
| 76-440 (K) | 0.43 | 72.6 | 31.9 | 18.5 | 19.5 |
| 76-379 (O) | 1.16 | 37.8 | 27.5 | 2.5 | 7.4 |

Figure 2:
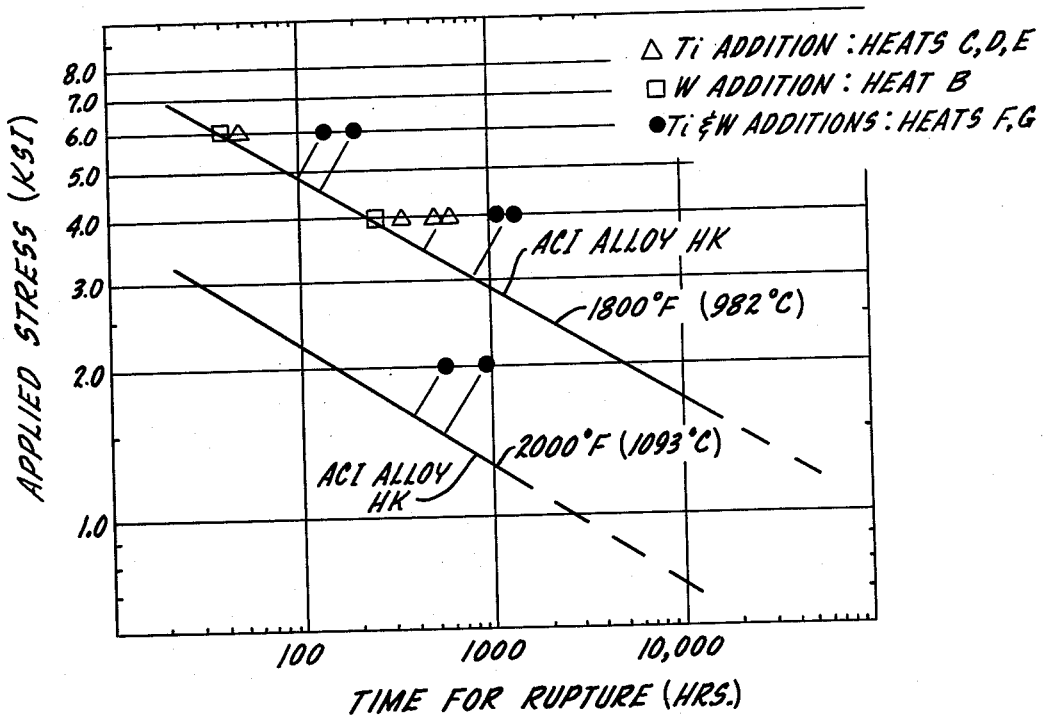
Figure 3:
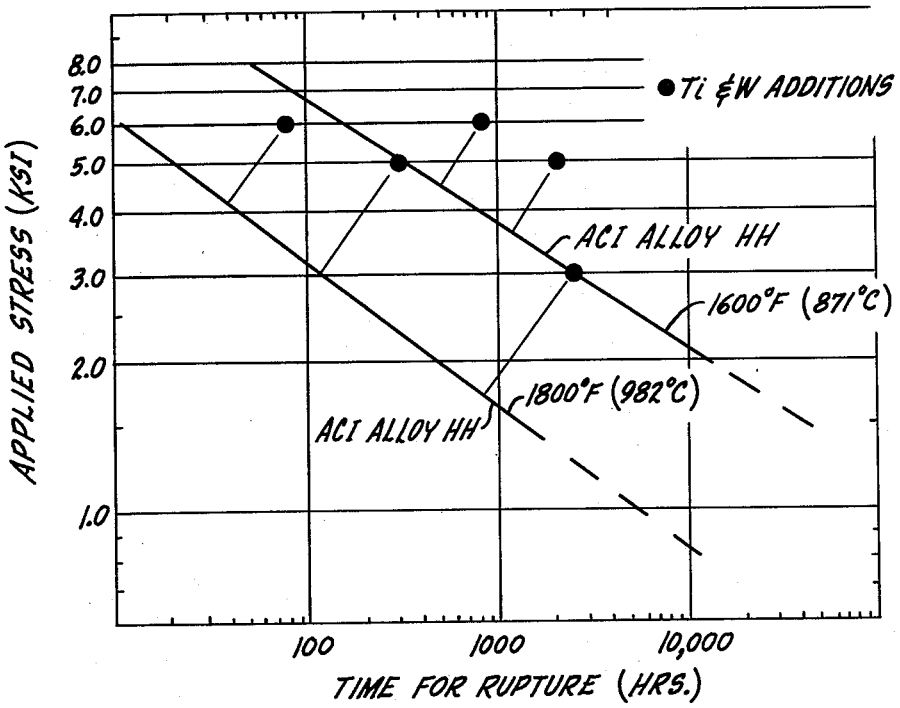
Figure 4:
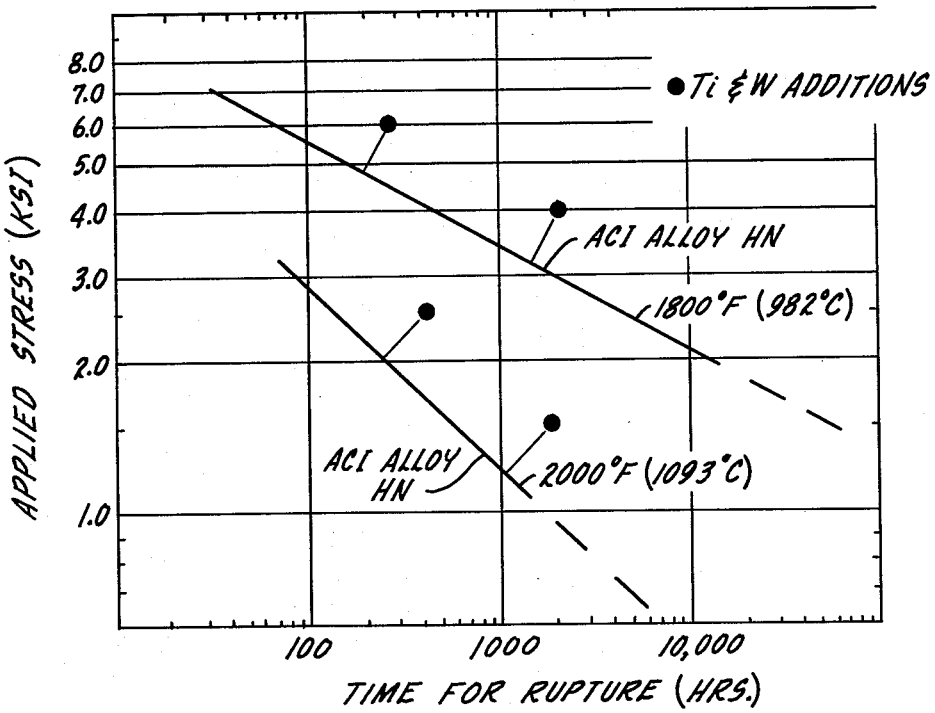
Figure 1:
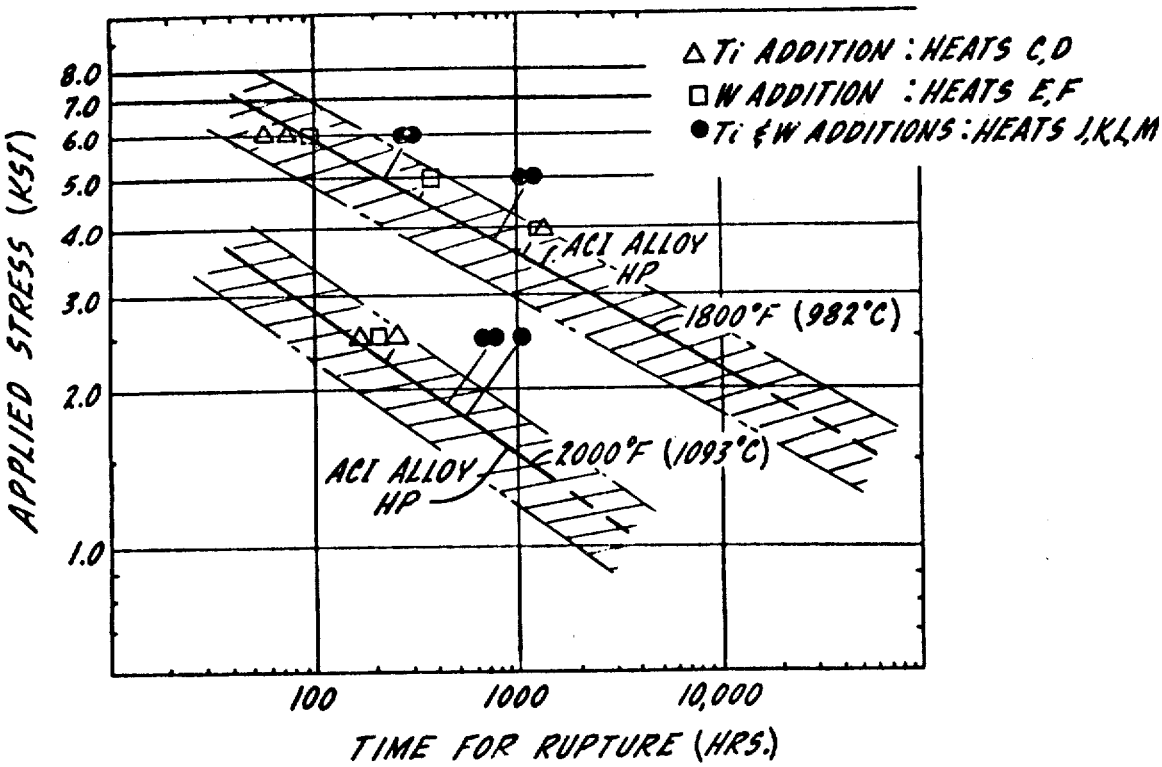
Figure 2:
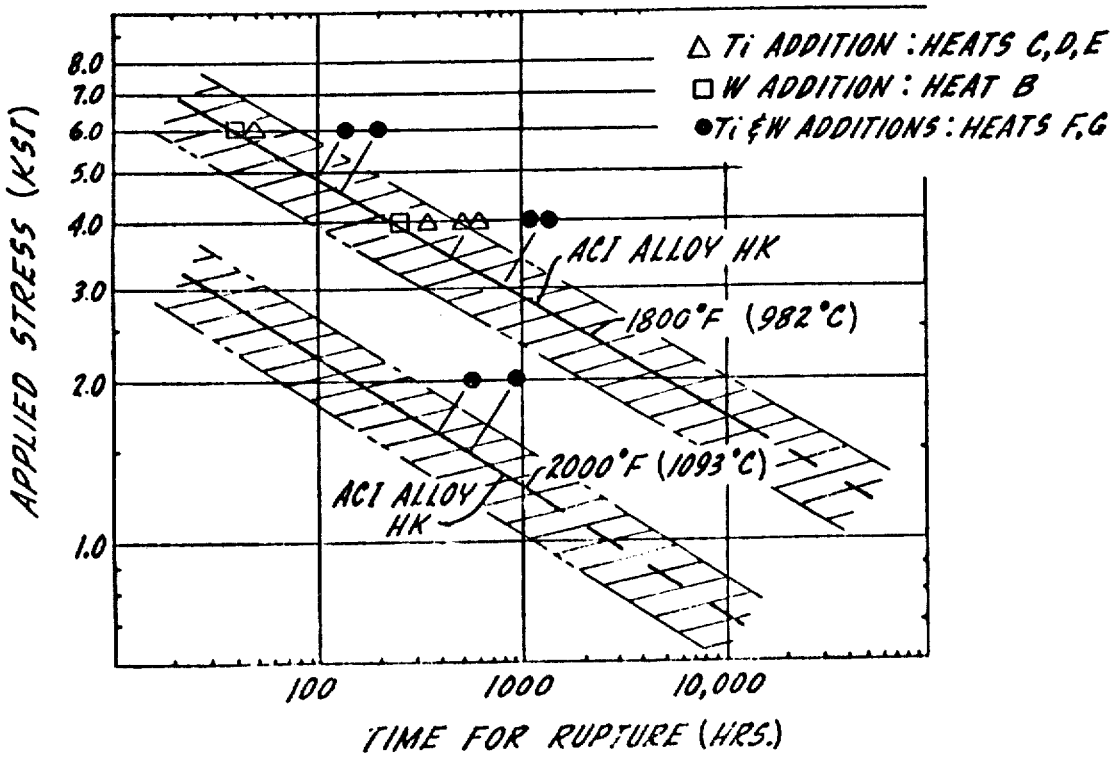
Figure 3:
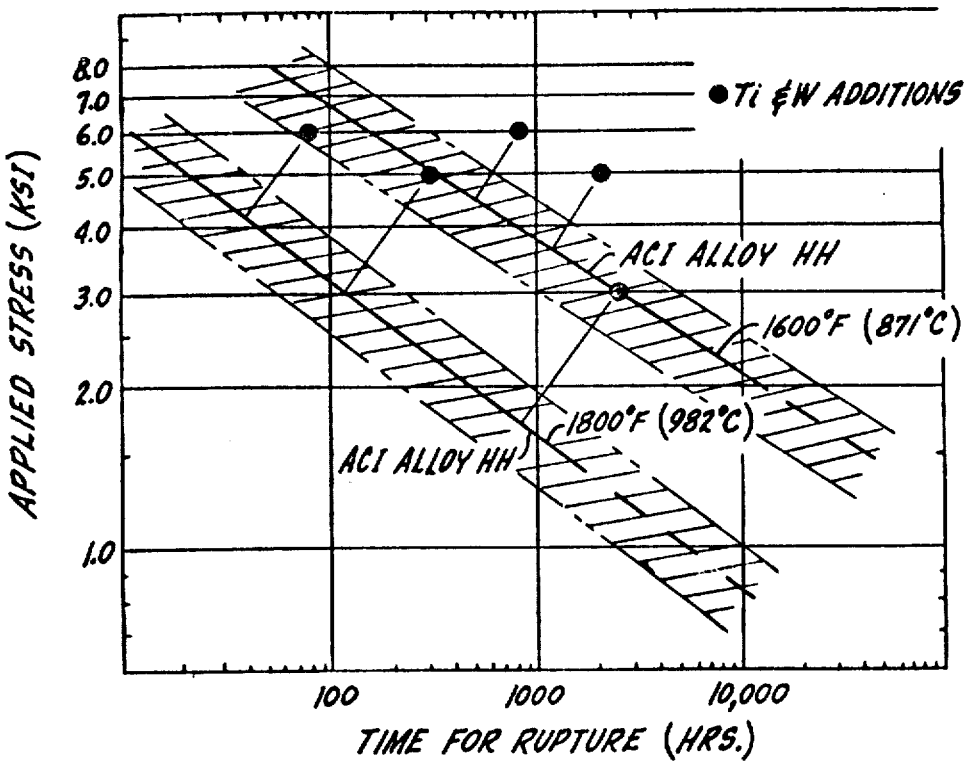
Figure 4:
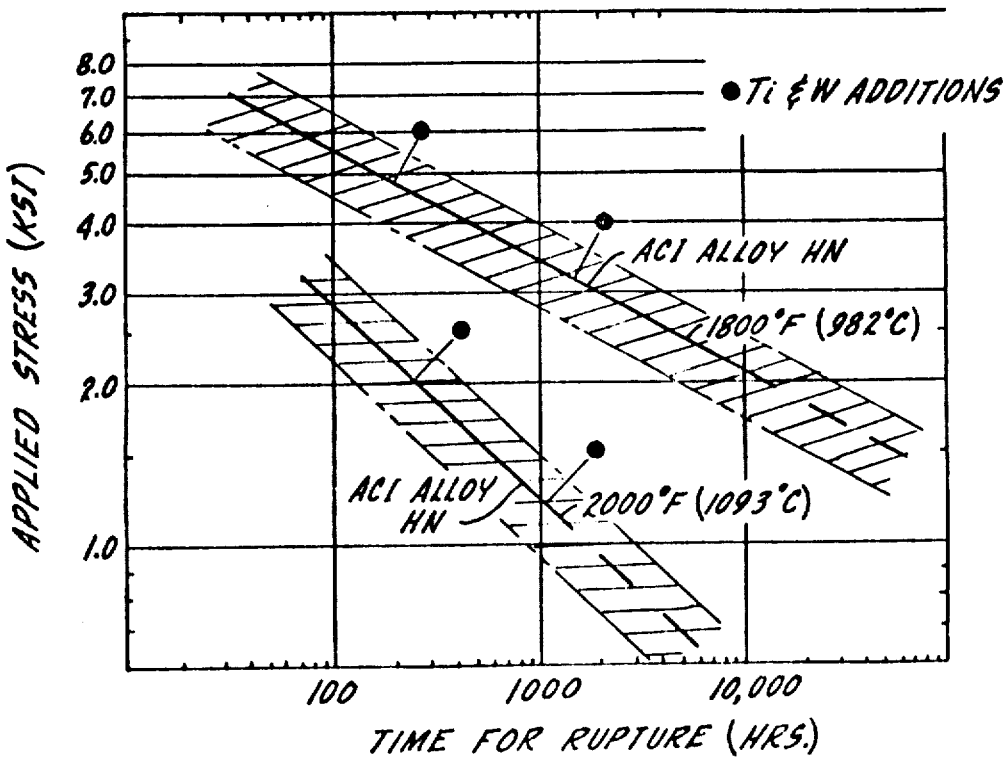

In the drawings (FIGS. 1-4) shading has been applied to the straight line relationships which themselves represent the central tendency of applied stress vs time of the standard ACI alloy grades for heat resistant castings. These central tendency lines have been published and are well known in this field of technology. The shading represents the expected scatter, plus or minus 20% of the applied stress.

It will be observed that all our data points, applicable to the combination of tungsten and titanium under the present invention, exceed the upper limit of the accepted plus-or-minus 20% scatter for the standard ACI cast alloy grades, varying from a minimum upward displacement of about 5% (HP type grade) to a maximum displacement of about 100% for the HH type grade.

The foundry superintendent needs latitude to account for unexpected oxidation or melting losses, variations in the furnace charge material and so on. In accordance with the present invention, and based on our previous foundry experience with commercial grades of iron-chromium-nickel heat resistant alloy castings, the following four alloys represent preferred foundry tolerance specifications for the more popular ACI grades, both centrifugal and static castings:

TABLE VII

| Comparable ACI Alloy | C% | Mn% | Si% | P% | S% | Cr% | Ni% | W% | Ti% | Fe% |
|---|---|---|---|---|---|---|---|---|---|---|
| HH | .2/.5 | 2/Max. | 3.5/Max. | .04/Max. | .04/Max. | 24/28 | 11/14 | .1/1.2 | .1/.6 | Bal. |
| HK | .2/.6 | 2/Max. | 3.5/Max. | .04/Max. | .04/Max. | 24/28 | 18/22 | .1/1.2 | .1/.6 | Bal. |
| HN | .2/.5 | 2/Max. | 3.5/Max. | .04/Max. | .04/Max. | 19/23 | 23/27 | .1/1.2 | .1/.6 | Bal. |
| HP | .2/.6 | 2/Max. | 3.5/Max. | .04/Max. | .04/Max. | 20/24 | 34/38 | .1/1.2 | .1/.6 | Bal. |

Within these ranges the preferred amount of tungsten, for best strength, is 0.1/0.6 and indeed this preferred amount applies to the ACI grades within the representative range HH through HW.

There is, however, a further bonus possible under the present invention, not necessarily requiring adherence to the optimum amount of tungsten. Referring to TABLE I it will be noted that when tungsten is in excess of the amount inducing maximum strength, when combined with titanium, the creep rupture life still exceeds that of the standard grade. Thus, while heat N, containing 1.06% tungsten, showed a decline of about 40 percent in rupture life (2000° F, 2.5 Ksi load) it outlasted the standard alloy casting by nearly three times (622 hours vs 196 hours).

It can be seen then that tungsten in excess of the optimum for strength may be permissible, either for no more reason than a broad allowance in the kind of scrap used in melting, or for some clearly defined additional benefit of which resistance to carburization is perhaps the best example, noting that tungsten is quite potent for that function. It is for reasons such as these that we conclude the amount of tungsten may be limited to about 2%, principally for economy because with tungsten in excess of about 0.6% it seems the strengthening effect has attained a plateau (a little below optimum as already noted) where the inclusion of tungsten for some other reason becomes a matter of balancing economy against results, particularly if tungsten exceeds two percent.

We have discovered an unusual confluence of beneficial properties effected by very small additions of tungsten and titanium operative in four representative commercial alloys representing a wide range of compositions. Our experience with those representative alloys permits us to anticipate a practical effect on hot tensile strength and ductility together with creep rupture over the following range (% by weight) of compositions, with the balance iron exclusive of the usual unavoidable foundry impurities (such as aluminum deoxidizer and molybdenum which may be present in impure melt stock) and tramp elements such as phosphorus and sulfur:

| | | | |
|---|---|---|---|
| Carbon | 0.25 | / | 0.8 |
| Chromium | 12.0 | / | 32 |
| Nickel | 8.0 | / | 62.0 |
| Manganese | 0 | / | 3.0 |
| Silicon | 0 | / | 3.5 |
| Tungsten | 0.05 | / | 2 |
| Titanium | 0.05 | / | <1 |

The effect is achieved in the presence of what would normally be considered high levels of nitrogen , as well as at the lower nitrogen levels representative of conventional induction melting practices, that is, nitrogen does not have an adverse effect. Possibly further enhancement of strength can be achieved by lower, or even higher levels of nitrogen; however, nitrogen up to 0.3% is doubtless permissable.

Any standard or preferred melting practice applicable to the known alloy bases may be used. Tungsten may be added as ferro-tungsten (which is not a strategic material) and titanium in sheet form may be added when the furnace is tapped; but to obtain maximum titanium recovery deoxidation should be made in the furnace or in any other manner suitable to the reduction of oxygen content to very low levels prior to the addition of titanium.

We recognize that this range of compositions encompasses certain combinations of extremes that might produce an alloy containing major to minor amounts of detrimental ferrite in its microstructure. These combinations are to be avoided, in that our alloys are intended to have a microstructure that is essentially austenite plus carbide (substantially free of ferrite) as seen in FIG. 5. The presence of ferrite in the microstructure promotes the eventual formation of the embrittling sigma phase at temperatures below 1700° F. The lower temperature limit for the formation of sigma is determined by specific alloy composition and by time of exposure, but embrittlement at temperatures as low as 1200° F has been observed. The presence of sigma would be generally detrimental to the life of these alloys under cyclic thermal loading and to ductility in general. For this reason, our invention should be practiced in alloys so balanced as to produce a microstructure essentially free of the sigma-forming ferrite.

In practice the alloy is cast essentially to the service configuration only requiring removal of the risers and gating, some machining perhaps where cosmetic appearance is important or where close tolerances are involved, and welding to complete an assembly from component as-cast parts in certain instances such as the assembly shown in FIG. 6. Even in the instance of welding the cast components to complete an assembly (of bends and straight sections, FIG. 6) those components individually have the configuration for service. Thus, heat treatment is not required to develop service properties.

Conceivably some cobalt or molybdenum might be present in trace amounts in a heat due to impure melt stock but in any event our alloy is essentially free of each and requires neither of those elements to produce the beneficial confluence of hot tensile strength, hot ductility and creep rupture strength bestowed uniformly, without exception, on standard ACI grades by so small a change. By the same token, the alloy is distinguishable from the so-called super alloys where large amounts of addition elements are employed for various purposes, of which cobalt and tungsten are examples, sometimes requiring vacuum melting techniques as compared to the present castings which may be cast atmospherically at ambient conditions.

Nonetheless the chief advantage of the alloy is the surprisingly large displacement in mechanical properties, achieved by little change and low cost, in the as-cast condition essentially ready for service without heat treatment: a casting with considerably greater reserves of hot tensile strength and ductility for increasing thermal fatigue resistance, with the added benefit of a significant increase in the value of creep rupture strength.

We claim:

1. A heat resistant alloy in as-cast form essentially in the configuration required for service, neither worked nor heat treated, said casting consisting of the following elements in weight percent:

| | |
|---|---|
| Carbon | 0.25 to 0.8 |
| Nickel | 8 to 62 |
| Chromium | 12 to 32 |
| Tungsten | 0.05 to not more than about 2 |
| Titanium | 0.05 to less than 1 |
| Silicon up to 3.5 | |
| Manganese up to 3 | |
| Niobium up to 2 | |
| Nitrogen up to 0.3 | |
| balance iron except for normal tramp elements deoxidizers and foundry impurities | |

wherein (a) the elements carbon, nickel and chromium are so balanced that the microstructure is austenite substantially devoid of ferrite whilst (b) the amount of tungsten combined with titanium is present in amounts which produce a value of creep rupture strength exceeding by at least five percent the creep rupture strength of the standard ACI cast alloys at least over the range HH through HP not containing tungsten and titanium.

2. A heat resistant alloy casting according to claim, 1 in which the amount of tungsten is in the range of about 0.1 to about 0.6 percent.

3. A heat resistant alloy casting according to claim 1 in which the amount of chromium is 24/28 and that of nickel is 11/14, in which tungsten is 0.1/1.2 and in which titanium is 0.1/0.6.

4. A heat resistant alloy casting according to claim 1 in which the amount of chromium is 24/28 and that of nickel is 18/22, in which tungsten is 0.1/1.2 and in which titanium is 0.1/0.6.

5. A heat resistant alloy casting according to claim 1 in which the amount of chromium is 19/23 and that of nickel is 23/27, in which tungsten is 0.1/1.2 and in which titanium is 0.1/0.6.

6. A heat resistant alloy casting according to claim 1 in which the amount of chromium is 20/24 and in which the amount of nickel is 34/38, in which tungsten is 0.1/1.2 and in which titanium is 0.1/0.6.

* * * * *

UNITED STATES PATENT AND TRADEMARK OFFICE

CERTIFICATE OF CORRECTION

PATENT NO. : 4,077,801

DATED : March 7, 1978

INVENTOR(S) : Bruce A. Heyer and Donald L. Huth

It is certified that error appears in the above-identified patent and that said Letters Patent are hereby corrected as shown below:

TABLE I, Heat (c), under N%, change "1.20" to --0.120--.

Delete Figures 1, 2, 3 and 4 of the drawings and substitute the figures 1, 2, 3 and 4 as shown on the attached sheets.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,077,801

DATED : March 7, 1978

INVENTOR(S) : Bruce A. Heyer and Donald L. Huth

It is certified that error appears in the above-identified patent and that said Letters Patent are hereby corrected as shown below:

TABLE 1, under Ti% delete ".100", under N% delete "(B)" and insert--.100--; under "N%" shift (B) to the next column to the right.

Column 9, line 50, after "rupture" insert--strength--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*